US009821438B2

(12) United States Patent
Xu et al.

(10) Patent No.: US 9,821,438 B2
(45) Date of Patent: Nov. 21, 2017

(54) SELF-ADJUSTING PLIERS

(71) Applicant: Meridian International Co., Ltd., Songjiang, Shanghai (CN)

(72) Inventors: Hua An Xu, Shanghai (CN); Qiang Wang, Shanghai (CN)

(73) Assignee: Meridian International Co., Ltd., Songjiang, Shanghai (CN)

( * ) Notice: Subject to any disclaimer, the term of this patent is extended or adjusted under 35 U.S.C. 154(b) by 276 days.

(21) Appl. No.: 14/691,652

(22) Filed: Apr. 21, 2015

(65) Prior Publication Data

US 2016/0001426 A1 Jan. 7, 2016

(30) Foreign Application Priority Data

Jul. 4, 2014 (CN) ..... 2014 1 0318060

(51) Int. Cl.
*B25B 7/10* (2006.01)

(52) U.S. Cl.
CPC ..... *B25B 7/10* (2013.01)

(58) Field of Classification Search
None
See application file for complete search history.

(56) References Cited

U.S. PATENT DOCUMENTS

| | | | |
|---|---|---|---|
| 4,651,598 | A | 3/1987 | Warheit |
| 4,802,390 | A | 2/1989 | Warheit |
| 4,893,530 | A | 1/1990 | Warheit |
| 5,060,543 | A | 10/1991 | Warheit |
| 6,101,908 | A | 8/2000 | Azkona |
| 6,694,848 | B1 | 2/2004 | Flavigny |
| 7,299,724 | B1 | 11/2007 | Warheit |
| 7,503,243 | B2 | 3/2009 | Putsch |
| 8,695,464 | B2 | 4/2014 | Hermann |

FOREIGN PATENT DOCUMENTS

| | | |
|---|---|---|
| CA | 2037455 | 9/1991 |
| CN | 1376102 | 10/2002 |
| CN | 2933719 | 8/2007 |
| CN | 101568408 | 10/2009 |

*Primary Examiner* — Joseph J Hail
*Assistant Examiner* — Brian Keller
(74) *Attorney, Agent, or Firm* — Shuttleworth & Ingersoll, PLC; Jason Sytsma

(57) ABSTRACT

Self-adjusting pliers include a first body having a handle on one end and a jaw on another end and a second body having a handle on one end and a jaw on another end. A piston is pivotally attached at a first end to the first body and pivotally attached at a second end to the second body and compressible about an axis extending between the first end and the second end.

13 Claims, 8 Drawing Sheets

SELF-ADJUSTING PLIERS

This Application claims priority to Chinese Patent Application No. CN201410318060.8 filed on Jul. 4, 2014 the contents of which are hereby incorporated by reference herein.

BACKGROUND

This disclosure relates to pliers, and, more specifically, this disclosure relates to self-adjusting pliers.

Attempts have been made in the past to provide for rapid adjustment of pliers' jaw members. Such pliers have a pair of pivotal crossed handle members and a slidable jaw member. One handle includes a fixed jaw which cooperates with the slidable jaw member. A toothed pawl is disposed about the pivot and projects into a slot in one handle member for engaging a plurality of slot teeth disposed therein. The pawl is biased into engagement with the slot teeth by a spring supported on the pivot. In operation, the pliers are adjusted over a work piece and pressure applied on the handles to cause a camming surface on one handle to cam against the edge of the slidable jaw and force it up against the work piece. Such pliers found in the prior art, however, are cumbersome and difficult to use.

SUMMARY

Self-adjusting pliers are disclosed. The pliers include a first body having a handle on one end and a jaw on another end and a second body having a handle on one end and a jaw on another end. A piston is pivotally attached at a first end to the first body and pivotally attached at a second end to the second body and compressible about an axis extending between the first end and the second end. The piston further comprises a sleeve, a spring positioned in the sleeve, and a guide bar for movement against the spring. A first rotational axis combines the first end of the piston to the first body, and a second rotational axis combines the second end of the piston to the second body. The first rotational axis and the second rotational axis cooperate to move the jaw on the first body toward the jaw on the second body. A longitudinal axis extends between the first rotational axis and the second rotational axis.

The pliers further include a slot in the first body between the handle and the jaw, and a pin combining the second body to the first body for movement in the slot. The slot comprises a sliding surface and a ratcheting surface. A pawl is combined to the pin for sliding movement on the sliding surface and one-way movement on the ratcheting surface.

A tension spring is attached to the second body at one end and to the second end of the piston at the other end to bias the jaw on the first body away from the jaw on the second body. A lock is combinable to the second end of the piston for holding the jaw on the first end with respect to the jaw on the second end.

DETAILED DESCRIPTION

Figure 1:
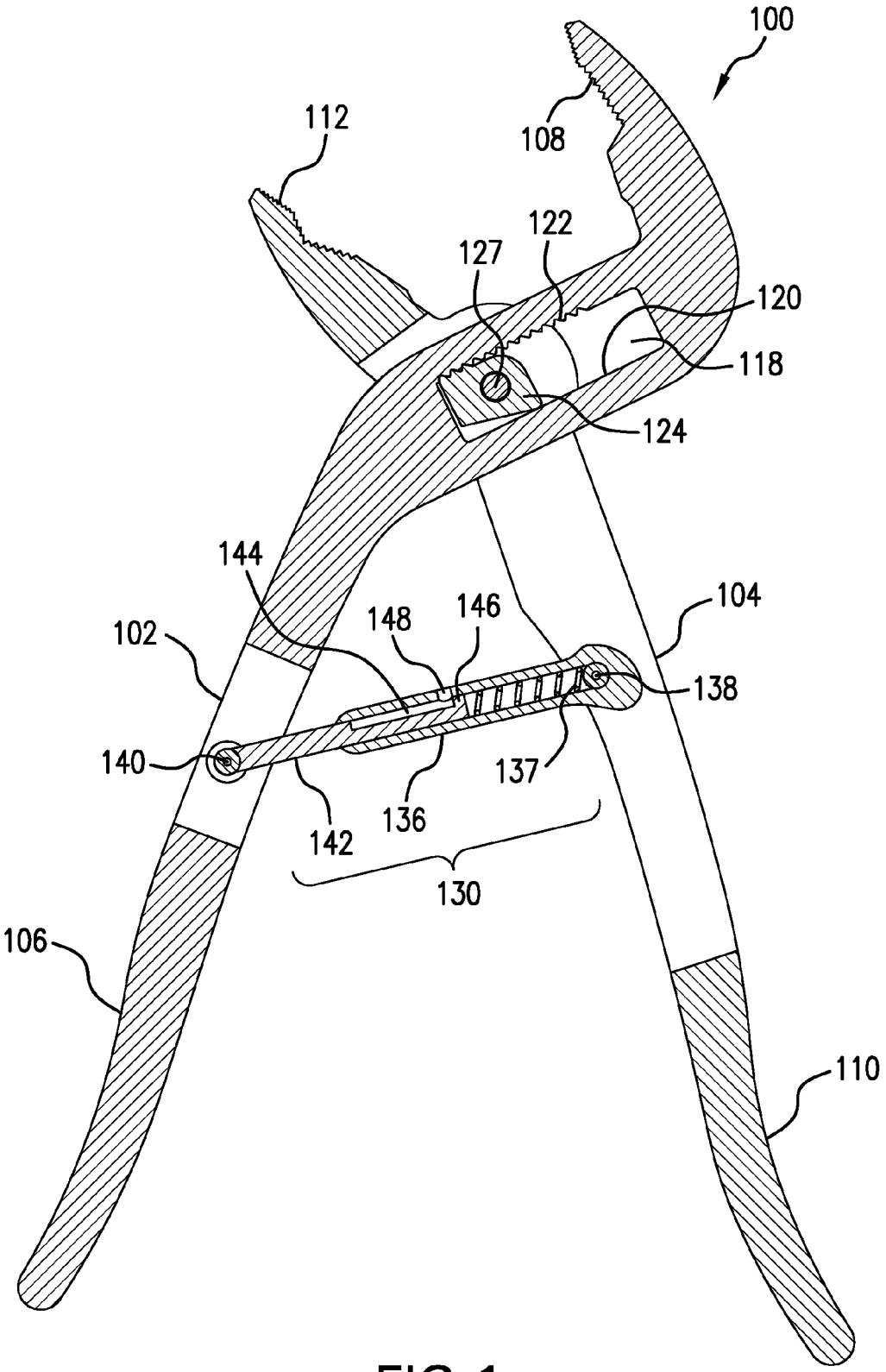
FIG. 1 shows a sectional view of the pliers according to an example in this disclosure.
Figure 2:
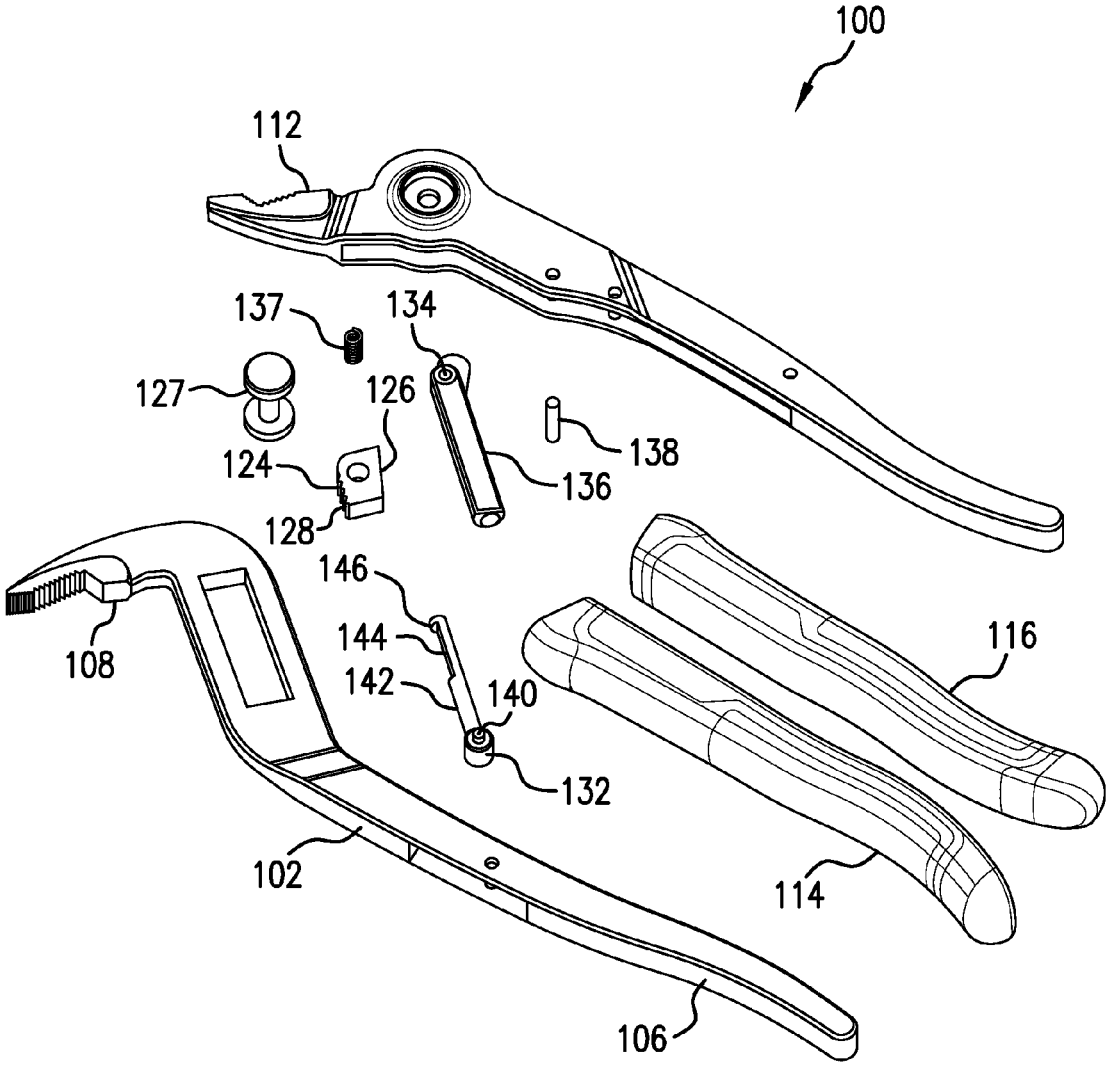
FIG. 2 shows an exploded view of the pliers of FIG. 1.
Figure 3:
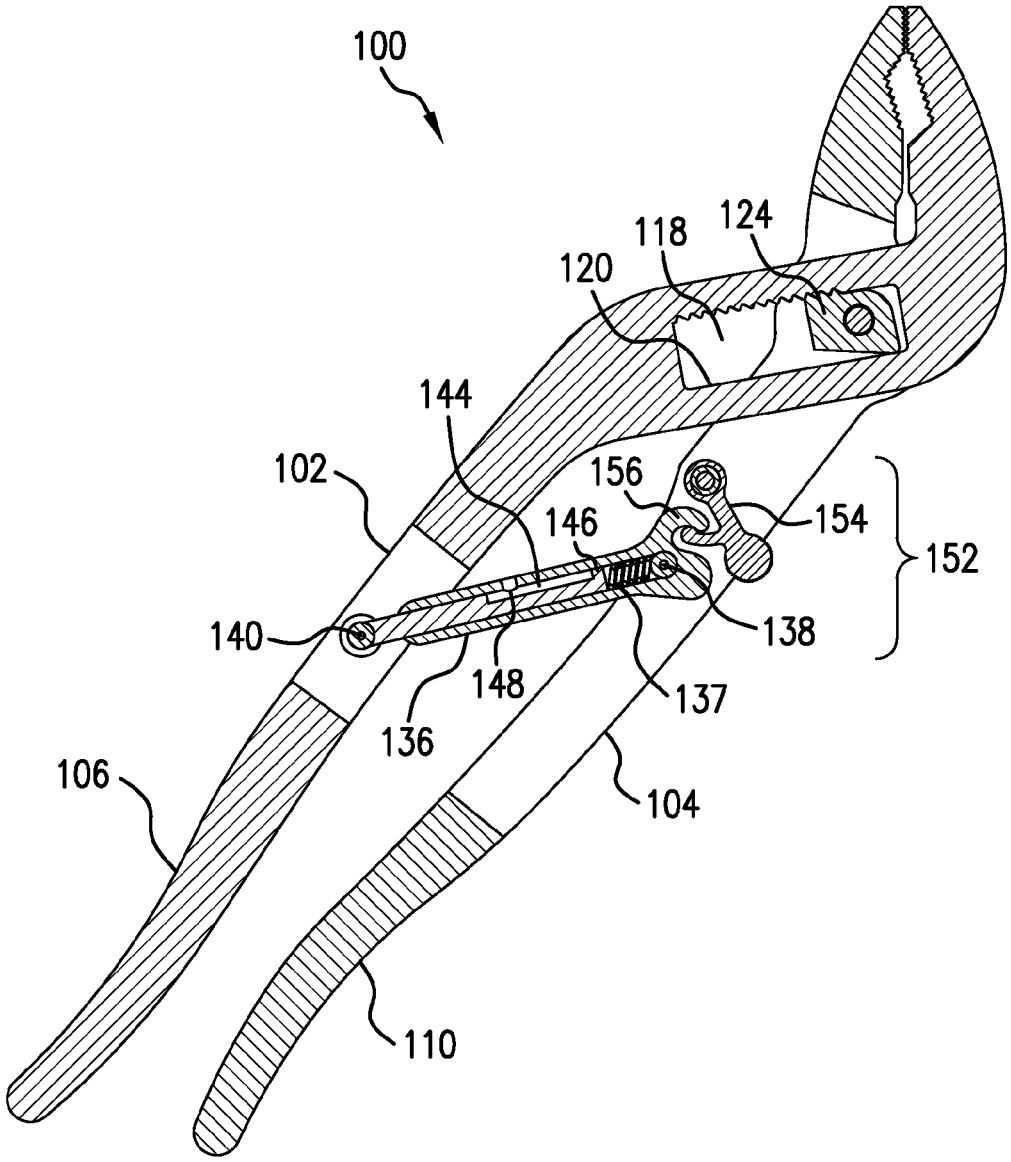
FIG. 3 shows a sectional view of the pliers according to another example in this disclosure.
Figure 4:
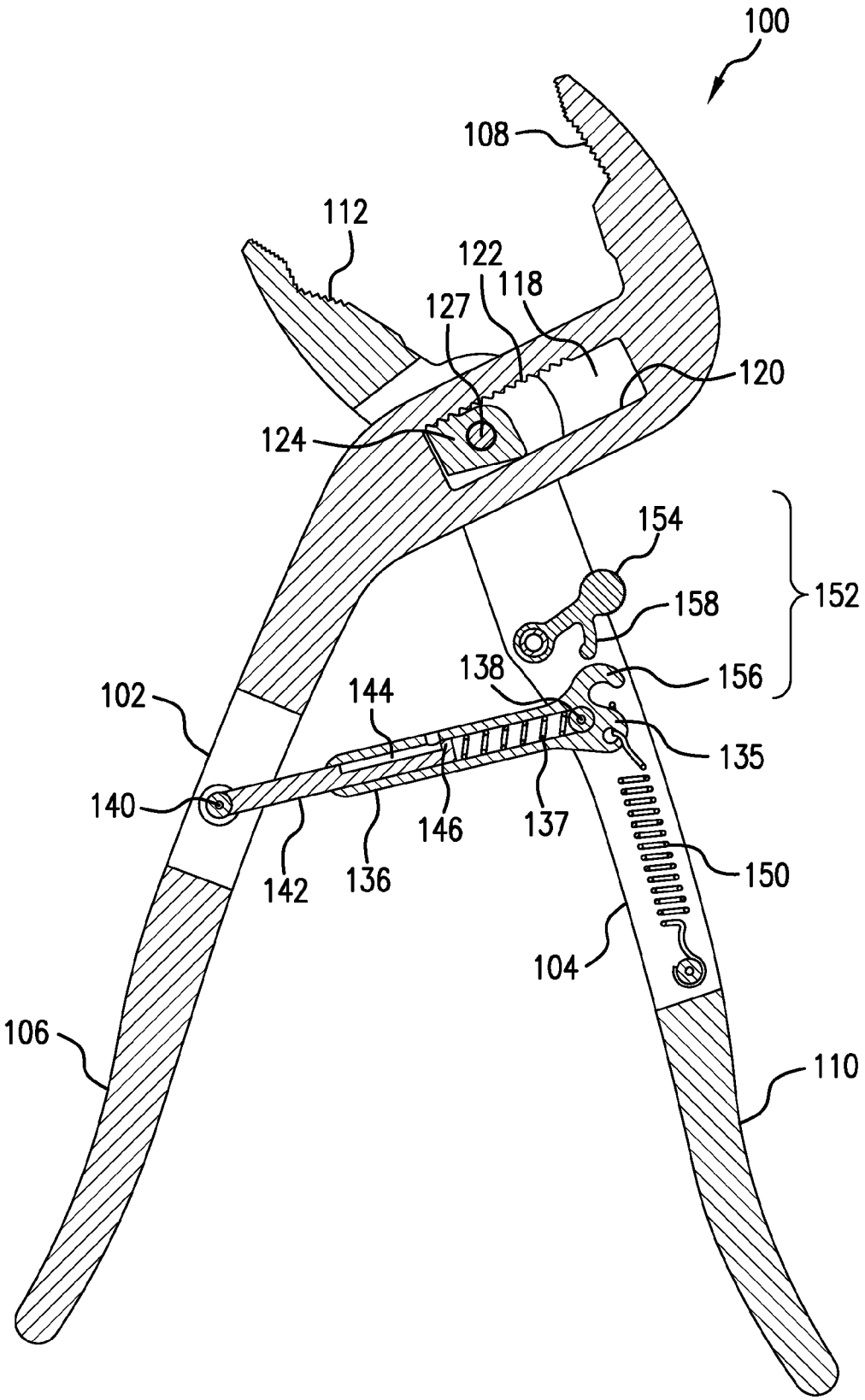
FIG. 4 shows a sectional view of the pliers according to another example in this disclosure.
Figure 5:
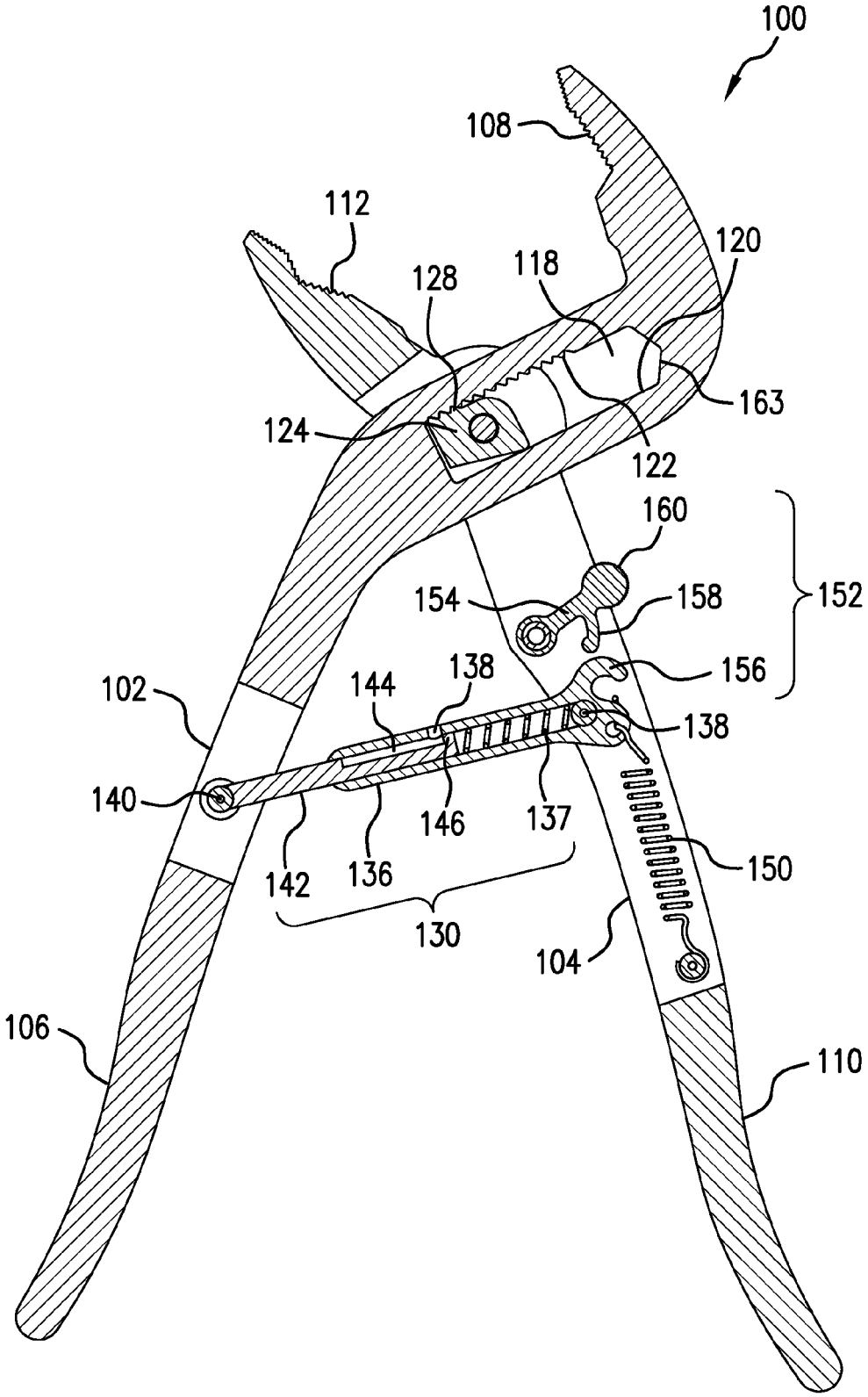
FIG. 5 shows a sectional view of the pliers according to another example in this disclosure taken along the 5-5 in FIG. 8.

FIGS. 1-8 illustrate pliers 100 according to similar examples described in this disclosure. As shown in FIG. 1, pliers 100 comprise a first body 102 and a second body 104. First body 102 has a handle 106 on one end and a jaw 108 on another end. Similarly, second body 104 has a handle 110 on one end and a jaw 112 on another end. The handle is configured for comfortable gripping by a user operating pliers 100, and may be contoured or provided with resilient plastic coverings 114, 116.

A slot 118 is provided in first body 102 between jaw 108 and handle 106. Slot 118 has a sliding surface 120 substantially parallel to a ratcheting surface 122. A pawl 124 is combined to second body 104 by pin 127 to guide jaw 112 of second body 104 toward jaw 108 of first body 102. Pawl 124 has a sliding surface 126 to cooperate with sliding surface 120 of slot 118. A ratchet mechanism is provided by teeth 128 on pawl 124 that cooperate with ratcheting surface 122 to provide one-way movement of second body 104 to hold jaw 112 of second body 104 with respect to jaw 108 of first body 102. FIGS. 3-8 show an example of pliers 100 with a camming surface 163 that cooperates with pawl 124 to guide pawl 124 upward and into engagement with ratcheting surface 122.

A piston 130 connects first body 102 and second body 104. Piston 130 has a first end 132 pivotally attached to first body 102 and a second end 134 pivotally attached to second body 104. A single longitudinal axis extends along piston 130 between first body 102 and second body 104 for a single axis of compression force. Piston 130 includes a sleeve 136 having contained therein a spring 137. Sleeve 136 is pivotally combined at one end to second body 104 by a pin 138. A guide bar 142 is pivotally combined to first body 102 by a pin 140. Guide bar 142 is positioned in sleeve 136 for back-and-forth, telescoping movement and biased outward by spring 137. Guide bar 142 has a recess 144 and a lock 146 to provide a path of travel for a pin 148 restrained to sleeve 136. Pin 148 of sleeve 136 is broad enough to encompass any shape (round, bearing, oval, rectangular, square, etc.), and has a smooth surface for sliding back and forth across recess 144 of guide bar 142.

FIGS. 4-8 show an example of pliers 100 with a tension spring 150 attached to second body 104 at one end and to sleeve 136 of piston 130 at the other end. Sleeve 134 has an off-center protrusion 135 with respect to its rotational axis at pin 138, so that as sleeve 136 of piston 130 is rotated tension spring 150 is extended upward. When second body 104 is released, tension spring 150 returns second body 104 back to its resting position.

In operation, pliers 100 has three phases of movement that may work independently, substantially simultaneously, or any combination. First, when first body 102 and second body are squeezed together, second body 104 pivots clockwise about pin 138 and is guided about slot 118 by sliding surface 126 of pawl 124, which brings jaw 112 of second body 104 toward jaw 108 of first body 102. Second, when the work piece is engaged between jaws 108, 112, second body pivots counter-clockwise about pin 140 to move pawl 124 upward and engage teeth 128 of pawl 124 with ratcheting surface 122 of slot 118 to prevent retraction. Third, first body 102 and second body 104 are brought closer together by the linear compression of piston 130.

Figure 6:
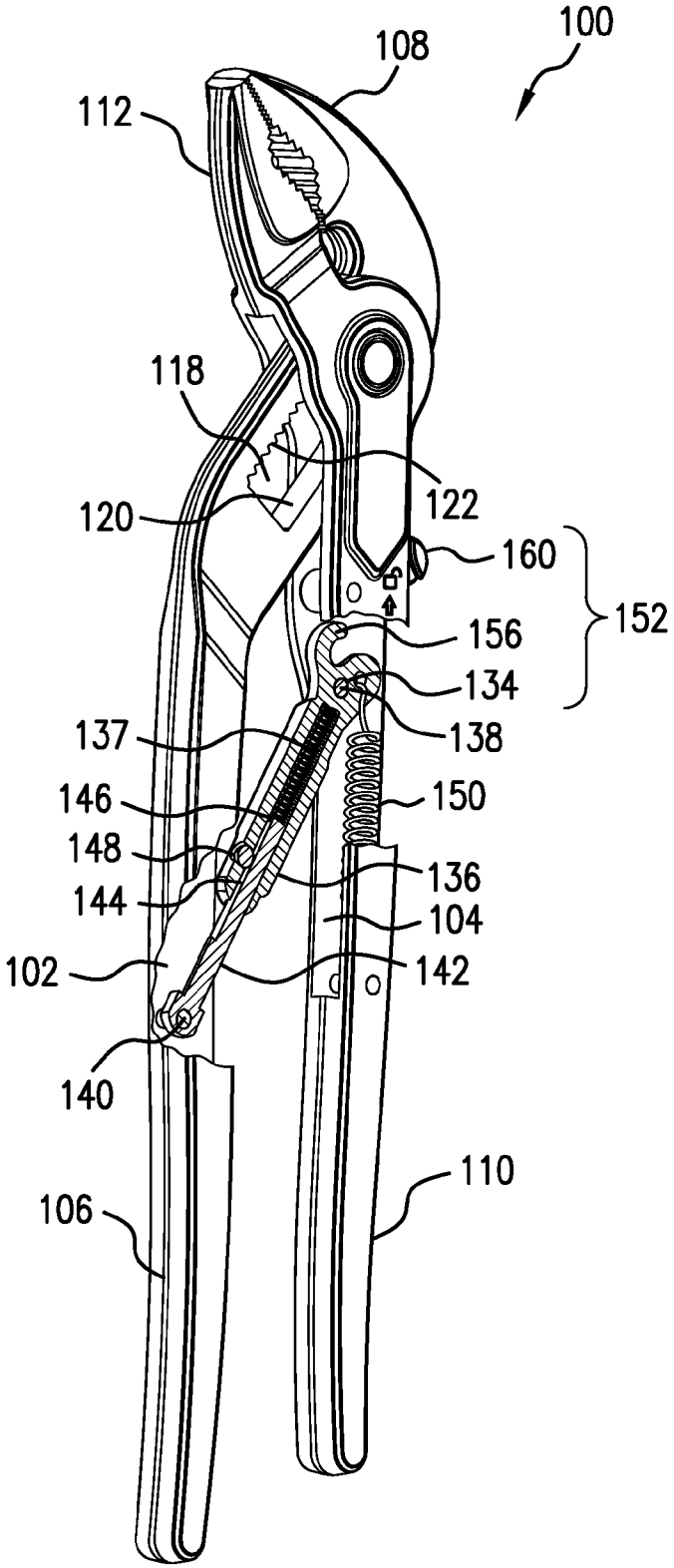
FIG. 6 shows a perspective view of the pliers of FIG. 5 in the closed position.
Figure 7:
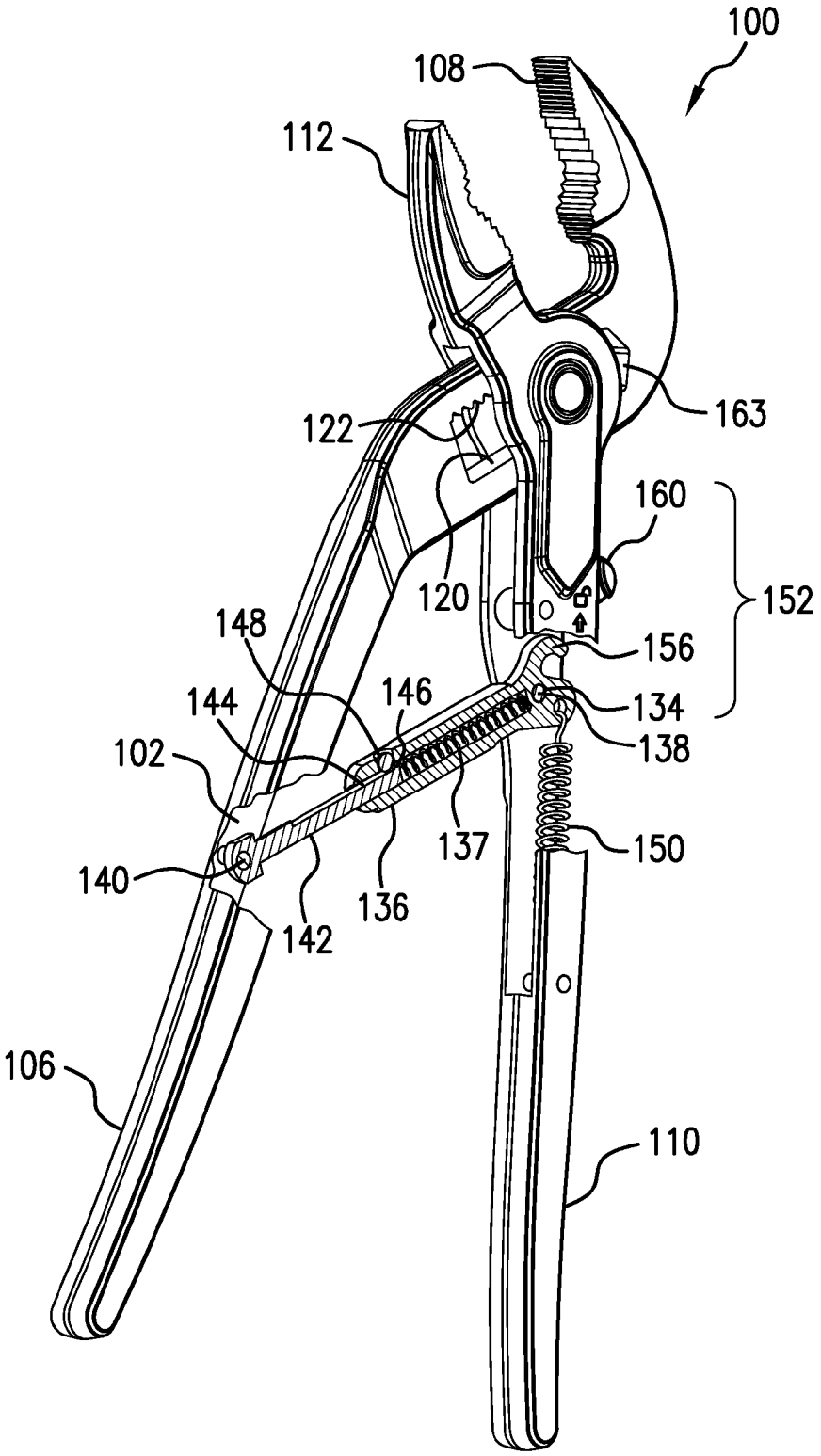
FIG. 7 shows a perspective view of the pliers of FIG. 5 in an intermediate position.
Figure 8:
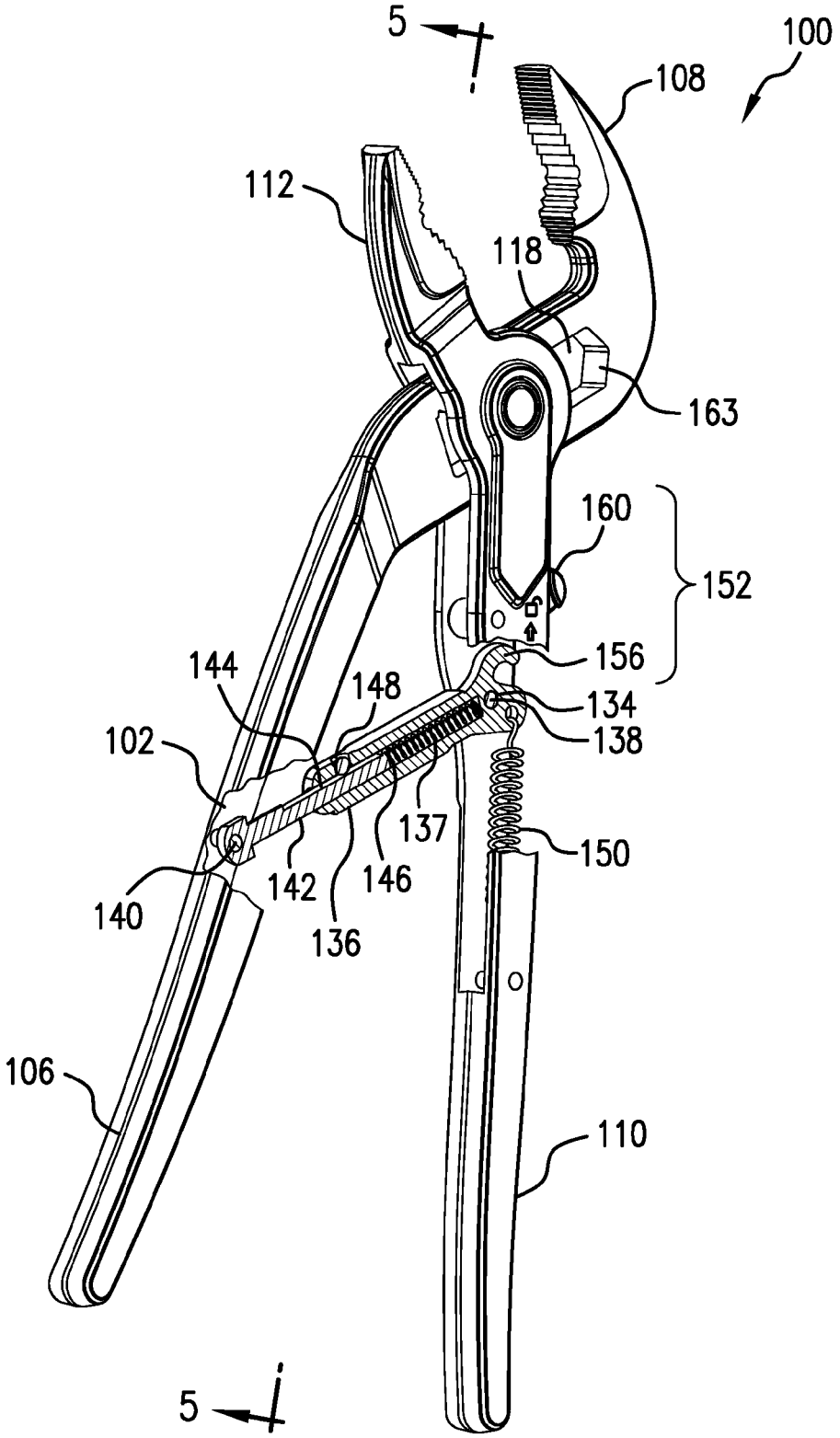
FIG. 8 shows a perspective view of the pliers of FIG. 5 in the open position.

FIG. 6 shows pliers 100 in the closed position. Second body 104 is pivoted clockwise about pin 138 to bring jaw 112 of second body 104 toward jaw 108 of first body 102. Second body 104 is pivoted upward and counter clockwise on pin 140 so that pawl 124 is engaged with ratcheting surface 122 of slot 118. Finally, piston 130 is compressed with guide bar 142 pushed into sleeve 136. Tension spring 150 is also extended so that when pliers 100 is released jaws 108, 112 will return to the open position. FIG. 7 shows an intermediate position. FIG. 8 shows jaws 108, 112 in the open position.

FIGS. 3-8 show an example of pliers 100 with a lock 152 for holding first body 102 with respect to second body 104. Lock 152 includes a securement arm 154 pivotally attached to second body 104. Securement arm 154 includes a hook 158 that cooperates with a hook 156 on sleeve 136. Securement arm 154 includes a protrusion 160 that extends out of second body 104 for convenient actuation by an operator. Operator can engage protrusion 160 to pivot securement arm 154 downward so hook 158 engages hook 156 on sleeve 136 to hold first body 102 with respect to second body 104.

While this disclosure has been particularly shown and described concerning various examples thereof, it should be understood by those of ordinary skill in the art that various changes, substitutions and alterations can be made herein without departing from the scope of this disclosure as defined by appended claims and their equivalents. Various aspects of any of the examples can be combined in different combinations than the ones shown to create new examples that fall within the scope of the appended claims.

Certain terminology is used herein to describe the different examples. Such terminology is used only for convenience when referring to the figures. The components can be oriented in any direction, and the terminology should therefore be interpreted to include such variations. This disclosure can be better understood by reference to the following claims. For purpose of claim interpretation, the transitional phrases "including" and "having" are intended to be synonymous with the transitional phrase "comprising."

What is claimed is:

1. Pliers comprising:

a first body having a handle on one end and a jaw on another end;

a second body having a handle on one end and a jaw on another end; and a piston pivotally attached at a first end to the first body and pivotally attached at a second end to the second body and compressible about an axis extending between the first end attached to the first body and the second end attached to the second body, wherein the piston further comprises a sleeve, a spring positioned in a cavity of the sleeve, and a guide bar comprising a guide bar lock at an end for movement against the spring such that the spring is positioned between an end of the cavity of the sleeve and the guide bar lock, wherein the guide bar further comprises a recess and the sleeve further comprises a pin, wherein the pin slides along the recess, and wherein the guide bar is prevented from being removed from the sleeve by the guide bar lock on the end of the guide bar.

2. The pliers of claim 1, and further comprising a slot in the first body between the handle and the jaw, and a pin combining the second body to the first body for movement in the slot.

3. The pliers of claim 2, wherein the slot further comprises a sliding surface and a ratcheting surface.

4. The pliers of claim 3, and further comprising a pawl combined to the pin for sliding movement on the sliding surface and one-way movement on the ratcheting surface.

5. The pliers of claim 1, and further comprising a tension spring attached to the second body at one end and to the second end of the piston at the other end to bias the jaw on the first body away from the jaw on the second body.

6. The pliers of claim 1, and further comprising a lock combinable to the second end of the piston for holding the jaw on the first end with respect to the jaw on the second end.

7. The pliers of claim 1, and further comprising a first rotational axis combining the first end of the piston to the first body and a second rotational axis combining the second end of the piston to the second body, wherein the first rotational axis and the second rotational axis cooperate to move the jaw on the first body toward the jaw on the second body.

8. The pliers of claim 7, a longitudinal axis extending between the first rotational axis and the second rotational axis.

9. Pliers comprising:

a first body having a handle and a jaw;

a second body having a handle and a jaw;

a ratchet mechanism for holding the first body with respect to the second body;

a piston comprising a guide bar that is pivotally combined to the first body and a sleeve that is pivotally combined to the second body, wherein the guide bar is positioned in the sleeve for telescoping movement in the sleeve against a spring in the sleeve, wherein the piston has a longitudinal axis that extends through the guide bar, the sleeve, and the spring, and wherein the guide bar includes a recess and a guide bar lock, and wherein the sleeve includes a pin that engages the recess and cooperates with the guide bar lock on the guide bar to prevent the guide bar from being removed from the sleeve; and a lock with a securement arm pivotally attached to the second body and comprising a hook that cooperates with a hook combined to the sleeve for holding the first body with respect to the second body.

10. The pliers of claim 9, wherein the ratchet mechanism further comprises a slot on the first body having a sliding surface and a ratcheting surface, and a pawl combined to the second body having teeth that cooperate with the ratcheting surface when the pawl is rotated into engagement with the ratcheting surface.

11. The pliers of claim 9, and further comprising a tension spring attached to the second body at one end and to an off-center protrusion on the sleeve on the other end, so that rotation of the sleeve causes the tension spring to extend.

12. Pliers comprising:

a first body having a handle on one end and a jaw on another end;

a second body having a handle on one end and a jaw on another end;

a piston comprising a sleeve, a spring positioned in a cavity of the sleeve, and a guide bar comprising a guide bar lock at an end for movement against the spring such that the spring is positioned between an end of the cavity of the sleeve and the guide bar lock of the guide bar, and the piston is connected between the first body and the second body to translate compressive force along a single axis from the second body to the first body; and wherein the guide bar further comprises a recess and the sleeve further comprises a pin, wherein the pin slides along the recess, and wherein the guide bar is prevented from being removed from the sleeve by the guide bar lock on the end of the guide bar.

13. The pliers of claim 12, and further comprising a first rotational axis combining the first end of the piston to the first body and a second rotational axis combining the second end of the piston to the second body, wherein the first rotational axis and the second rotational axis cooperate to move the jaw on the first body toward the jaw on the second body, wherein the single axis extends between the first rotational axis and the second rotational axis.

* * * * *